United States Patent [19]

Tarrson et al.

[11] Patent Number: 5,027,467

[45] Date of Patent: Jul. 2, 1991

[54] TOOTHBRUSH

[75] Inventors: Emanuel B. Tarrson; Dane Maric; Lew Blahuta, all of Chicago, Ill.

[73] Assignee: John O. Butler Company, Chicago, Ill.

[21] Appl. No.: 475,724

[22] Filed: Feb. 6, 1990

[51] Int. Cl.[5] ..... A46B 9/04

[52] U.S. Cl. ..... 15/167.1; 15/145; 15/176.5; 15/176.6; 132/321; 433/147; 403/397

[58] Field of Search ..... 15/145, 167.1, 176.1, 15/176.4, 176.5, 176.6, 206, 185; 132/308, 311, 321, 329; 433/147; 403/373, 397, 405.1

[56] References Cited

U.S. PATENT DOCUMENTS

| | | | |
|---|---|---|---|
| 2,556,500 | 6/1951 | Levine | 15/167.1 |
| 3,559,226 | 2/1971 | Burns | 15/167.1 |
| 4,222,143 | 9/1980 | Tarrson et al. | 15/167.1 |
| 4,319,377 | 3/1982 | Tarrson et al. | 15/167.1 |
| 4,572,223 | 2/1986 | Rosenfeld | 15/167.1 |
| 4,710,996 | 12/1987 | Tarrson et al. | 15/167.1 |
| 4,751,761 | 6/1988 | Breitschmid | 15/176.5 |
| 4,780,923 | 11/1988 | Schultheiss | 15/167.1 |
| 4,805,252 | 2/1989 | Tarrson et al. | 15/167.1 |
| 4,850,074 | 7/1989 | Klevan | 15/185 |

FOREIGN PATENT DOCUMENTS

| | | | |
|---|---|---|---|
| 20268 | 12/1980 | European Pat. Off. | 15/185 |
| 334346 | 1/1936 | Italy | 15/176.1 |
| 175973 | 6/1935 | Switzerland | 15/176.1 |

*Primary Examiner*—Philip R. Coe
*Assistant Examiner*—Mark Spisich
*Attorney, Agent, or Firm*—Laff, Whitesel, Conte & Saret

[57] ABSTRACT

An interdental toothbrush has a hinged cap on the end of an elongated handle. The cap has a hole which is positioned relative to a groove so that a twisted wire brush may be locked into place simply by inserting it and closing the cap.

9 Claims, 2 Drawing Sheets

TOOTHBRUSH

This invention relates to handles for interdental toothbrushes, and more particularly to toothbrush handles which have a lower cost and which, nevertheless, firmly and securely holds a twisted wire brush in place.

A number of U.S. Pat. Nos. show interdental toothbrushes: 3,559,226; 4,303,199; 4,222,143; 4,319,377; 4,572,223; 4,691,404; 4,710,996; and 4,780,923.

A regular toothbrush is severely limited as to the tooth and gum surfaces that it can reach. The importance of brushing includes a cleaning of the tooth itself. However, it also includes a massaging of the gums and a cleaning of the sulcus or marginal area below the nominal gumline and between the tooth and gum. This massaging tends to thicken the gum tissue and to make it healthier.

As a result of these needs, it is common practice to provide a small twisted wire brush which may fit within and through the spaces between, around, and under teeth, bridges, and the like. This use of a twisted brush leads to two problems. One problem is to provide a brush which projects from a handle at approximately a right angle thereto. The other problem is to securely lock the brush in place at the lowest possible cost. The locking is a relatively severe problem since there is a substantial leverage acting upon the brushes. The low cost is also a relatively severe problem since the field of personal appliances, especially toothbrushes, is a highly competitive field. Fractions of a cent per unit make the difference between commercial success and failure.

A conventional toothbrush handle structure is made on automatic plastic molding machines, many of which work unattended. For example, it is possible to switch on such a machine and then go home for the night. All night long, the machine is producing parts with no one present to observe the machine in operation. With a use of such convention production techniques, the cost of the interproximal handle may also be reduced to something in the order of a mere fraction of a cent.

Another consideration is the convenience for the user. Many people who have bridges and a large gap between their teeth, especially at the root line, are quite elderly. Their hands may be stiff, their eyesight impaired, etc. Thus, there may be many reasons why they find it most difficult to use some of the prior art interdental handles where the brush stem has to be manipulated. Therefore, the ease of brush installation and replacement is also a very important consideration.

Accordingly, an object of the invention is to provide new and novel handles for interdental toothbrushes. Here, an object is to reduce cost by making a single piece part which provides the above described features. Stated otherwise, an object is to eliminate loose parts which must be manipulated while holding the brush in position.

In this connection, an object of the invention is to provide a system wherein the brushes may be installed and replaced quickly and easily, even by a person having impaired eyesight and with less than completely normal facility to use their hands.

In keeping with an aspect of the invention, these and other objects are accomplished by providing an elongated toothbrush handle with a locking cap pivotally connected thereto. A hole in the cap and a groove in the handle receive the twisted wire stem Therefore, one only has to pass the twisted wire stem through the hole in the cap and then close it. As the cap closes, the wire stem is captured within the groove. A knob on the cap passes through a hole in the handle, with an interference fit. When the knob has so passed through the hole, the cap is locked in place with the brush firmly held thereby.

A preferred embodiment of the invention is shown in the attached drawings, wherein.

Figure 1:
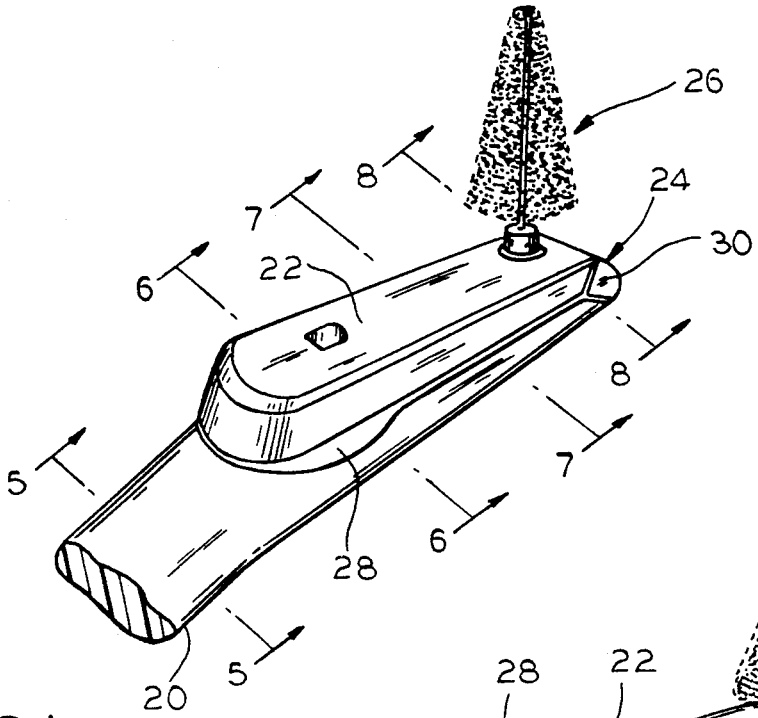
FIG. 1 is a perspective view of one side of the inventive toothbrush with the twisted wire brush in place.
Figure 2:
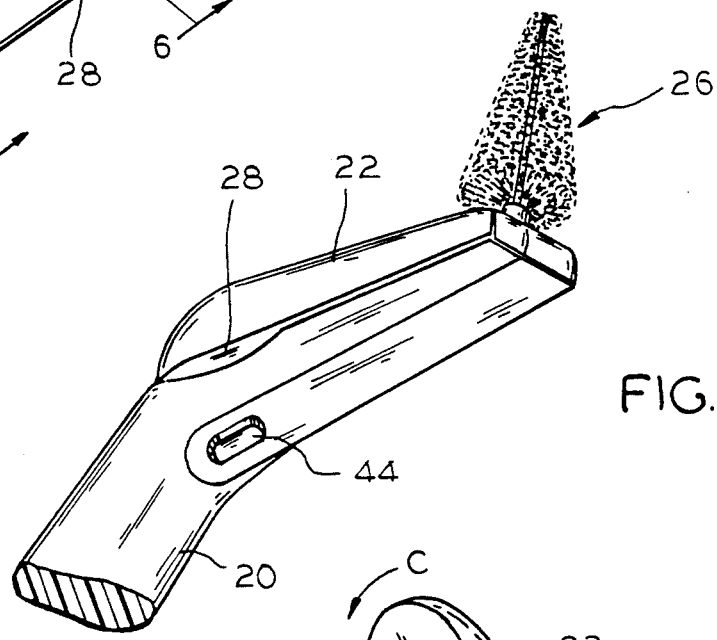
FIG. 2 is a perspective view of the opposite side of the toothbrush of FIG. 1.

The inventive toothbrush as used is best seen in FIGS. 1, 2, as comprising handle 20 having a locking cap 22 joined thereto by a double living hinge at 24. A twisted wire brush is seen at 26. When the cap 22 is closed over the handle 20 the brush is firmly locked in place.

The exterior contours are generally smooth with a blended curve so that there are no rough or projecting members which may catch or feel rough to the cheek or gum tissue. The handle is undercut at 28 in order to give an entrance for a thumb nail to lift the cap 22 away from the handle 20 for replacing the twisted wire brush.

Figure 4:
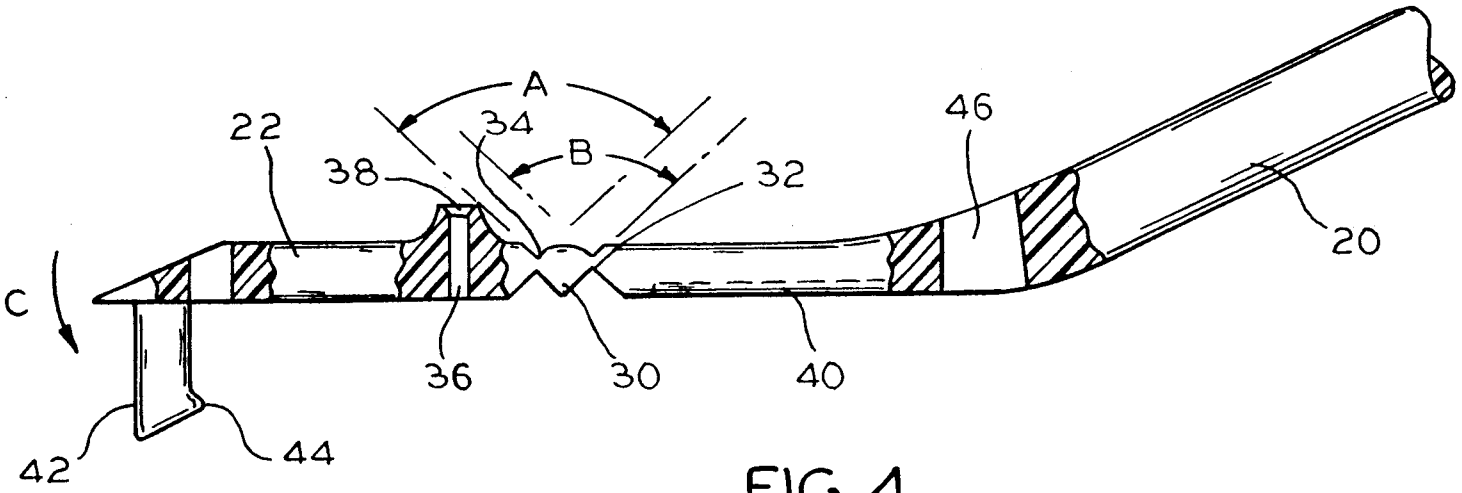
FIG. 4 is a side elevation partly in cross section, of the toothbrush as it appears when it emerges from the mold.
Figure 8:
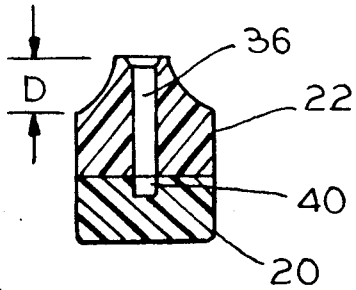
FIGS. 5–8 are cross-sections of the handle (without the brush) taken along lines 5—5; 6—6; 7—7; and 8—8, respectively, of FIG. 1.

The double living hinge includes a member 30 (FIG. 4) having a triangular cross section and joined on one side to the handle 20 by a thin membrane 32 and joined on the other side to the cap 22 by a thin membrane 34. The thin membranes 32, 34 function as the living hinge on which the cap 22 and handle 20 pivot relative to each other. The membranes are formed at the roots of angles A, B by radiusing a mold at about 0.005-inch.

The cap 22 has a projecting chimney like member with a hole 36 formed therein for receiving the stem of a twisted wire brush. The outer end of the hole 36 is chamfered or beveled at 38 in order to form a funnel shaped opening for guiding, directing, and receiving the end of the twisted wire brush, to facilitate an insertion thereof.

Figure 3:
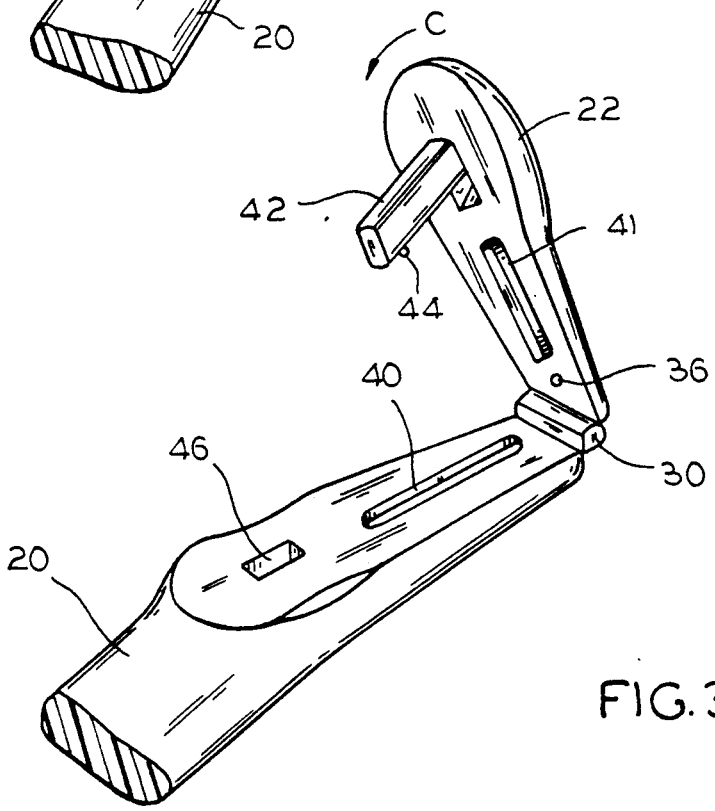
FIG. 3 shows the toothbrush handle without the twisted wire brush and with the locking cap a half open, half closed position.

A groove 40 is formed preferably in the handle at a location which is aligned with the hole 36. The hole and groove may also be at reversed locations. As shown in FIG. 3, an optional Rib 41 may be formed on cap 22 at a position which enters the groove 40, in order to trap the twisted wire brush stem. Therefore, if a wire stem projects through hole 36 at a time when the cap 22 is closed, (swing in direction C), the end of the stem enters and bends as it slides along the groove 40.

When the cap is locked in a closed position, the wire stem is located in position within both the hole 36 and the groove 40. At this time the wire stem is bent to have a somewhat L-shape, with one arm of the "L" locked in groove 40 and the other arm of the "L" passing through the hole 36. The brush is on the opposite end of the stem arm which passes through hole 36.

The cap 22 includes an upstanding latching knob 42 having an enlargement 44 thereon. A corresponding keeper hole 46 is positioned in the handle 20 at a point which the knob engages as the cap swings from an open to a closed position. The enlargement 44 causes a friction fit as it passes through the keeper hole 46. Once the enlargement clears the far side of the keeper hole, the cap is locked into position. As seen in FIG. 2, the enlargement 44 on the top of knob 42 and at the far end of keeper hole 36 acts as a push button which may be pushed in order to help initiate an opening of the cap.

Figure 5:
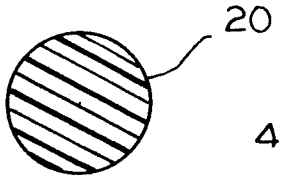

The construction of the toothbrush handle may become more apparent from a study of FIGS. 5–8, which are four cross sections taken at locations identified in FIG. 1. As shown in FIG. 5, the handle above the cap (section line 5—5) is simply a solid piece of molded plastic, of any suitable geometric configuration (here circular cross-section).

At the latching end (section 6—6), the cap 22 (FIG. 6) is wide then the handle is the area where the handle is undercut at 28. This provides shoulders 48, 48 which may be caught by a thumb nail to further help open the cap.

Figure 7:
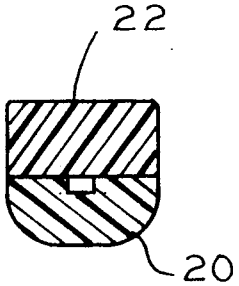
Figure 6:
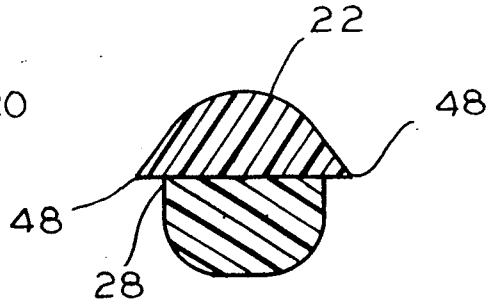

Further down the handle (section 7—7) toward the hinged end 24, the cap 22 (FIG. 7) and handle 20 have substantially the same dimensions to form a smooth contour. At this point, the groove 40 becomes a hole for receiving the end of the twisted wire stem when the cap 22 is latched in a closed position. Not shown in FIG. 7 is the optional rib 41 (FIG. 3). If shown, the rib 41 would fill the top half of the groove 40 (FIG. 7).

Further down the handle (Section 8—8), the cap is formed into a chimney or extension having a height D which further helps stabilize the twisted wire stem. Preferably, the distance D extends far enough to reach the bristles of the brush, thus lessening any tendency for the wire stem to bend, at random, during the use thereof.

Those who are skilled in the art will readily perceive how to modify the invention. Therefore, the appended claims are to be construed to cover all equivalent structures which fall within the true scope and spirit of the invention.

The claimed invention is:

1. A toothbrush for holding a twisted wire brush, said toothbrush comprising an elongated handle member having a cap joined to the end thereof vai a living hinge, said cap and said handle having a complementary latching knob and keeper hole, one of said knob and hole being on said cap and the other of said knob and hole being on said handle, said knob entering said keeper hole when said cap is swung on said hinge to a closed position on said handle keeper, a hole formed in said cap near said hinged end, said hole having dimension for receiving and holding the bare stem wire of a twisted wire brush, and a groove formed on said handle, said groove extending from said hole toward said latching knob, said groove having a dimension for receiving and holding said bare twisted wire stem, said cap having a protrusion which extends outwardly therefrom to form a somewhat chimney-like extension of said hole for stabilizing and reinforcing the bare stem wire of said twisted wire brush.

2. A toothbrush for holding a twisted wire brush, said toothbrush comprising an elongated handle member having a cap joined to the end thereof via a living hinge, said cap and said handle having a complementary latching knob and keeper hole, one of said knob being on said cap and the other of said knob and hole being on said handle said knob entering said keeper hole when said cap is swung on, said hinge to a closed position on said handle member, the end of said latching knob protrudes beyond said toothbrush when said cap and handle are in a latched position, said protruding end forming a push button for opening said cap relative to said handle, a hole formed in said cap near said hinged end, said hole having a dimension for receiving and holding the bare stem wire of a twisted wire brush, and a groove formed on said handle, said groove extending from said hole toward said latching knob, said groove having a dimension for receiving and holding said bare twisted wire stem.

3. The toothbrush of either claim 1 or claim 2 wherein the positions and dimensions of said hole and groove are such that a stem of a twisted wire brush projecting through said hole automatically bends and fits into said groove as said cap is closed over and latched to said handle.

4. The toothbrush of either claim 1 or claim 2 wherein one of said cap and handle has an undercut region which enables an entrance of a thumb nail to lift said cap off said handle.

5. The toothbrush of either claim 1 or claim 2 wherein said hinged end has a member with a triangular cross section separating two living hinges for joining said member to said handle and to said cap respectively.

6. A toothbrush for holding a twisted wire brush, said toothbrush comprising an elongated handle member having a cap joined to the end thereof via a living hinge, said cap and said handle having a complementary latching knob and keeper hole, one of said knob and hole being on said cap and the other of said knob and hole being on said handle, said knob entering said keeper hole when said cap is swung on said hinge to a closed position on said handle member, a hole formed in said cap near said hinged end, said hole having a dimension for receiving and holding the bare stem wire of a twisted wire brush, and a groove formed on said handle, said groove extending from said hole toward said latching knob, said groove having a dimension for receiving and holding said bare twisted wire stem, and a rib formed on said cap for fitting into said groove and helping lock said twisted wire in place.

7. A toothbrush for cleaning interdental spaces, said toothbrush comprising a handle having a cap joined to the end thereof by a living hinge, said cap closing over said handle and lying in longitudinal alignment therewith, said handle and cap having complementary contours for latching them together when closed in said longitudinal alignment, a hole extending through said cap and into a groove in said handle with an alignment that holds a stem of a twisted wire brush when in an L-shaped configuration; an arm of said L-shape carrying a brush extending through said hole and another arm of said L-shape fitting into said groove, and a chimney-like extension of said cap, said extension being positioned to continue said hole for tending to preclude a bending of said wire stem when said brush is in use.

8. The toothbrush of claim 7 and means associated with said cap and handle for facilitating an unlatching of said handle and said cap.

9. The toothbrush of claim 7 wherein said L-shape of said twisted wire stem forms automatically responsive to a closing of said cap over said handle.

* * * * *